United States Patent [19]

Hsieh

[11] Patent Number: 5,024,603

[45] Date of Patent: Jun. 18, 1991

[54] PROTECTION DEVICE FOR USE ON ELECTRICITY SOCKET

[76] Inventor: Shi-Nan Hsieh, P.O. Box 10780, Taipei, Taiwan

[21] Appl. No.: 568,896

[22] Filed: Aug. 17, 1990

[51] Int. Cl.[5] ..... H01R 13/44

[52] U.S. Cl. ..... 439/148; 439/136

[58] Field of Search ..... 439/135, 136, 142, 148

[56] References Cited

U.S. PATENT DOCUMENTS 3,989,334 11/1976 Tortino ..... 439/148

4,435,032 3/1984 Abramson et al. ..... 439/136

FOREIGN PATENT DOCUMENTS 0274069 6/1951 Switzerland ..... 439/148

*Primary Examiner*—Paula A. Bradley

*Attorney, Agent, or Firm*—Pollock, Vande Sande & Priddy

[57] ABSTRACT

A protection device includes a case, an elastic plugging element and locking element. The case is formed with three holes at its three sides, two of which are arranged oppositely, and a pair of holes at its bottom. The elastic locking element located in the case having two shoulders and a waist is formed at one end a pair of claws to secure it on the case and at the opposite end a pressing end projecting out from a side hole of the case. The plugging element has two zigzag edged set legs to stick through the pair of holes at the bottom of the case. The bases of the set legs at their upper ends are spaced from each other so as to form a preparing area and they stretch horizontally to stick out from the other two opposite side holes of the case to be the other two pressing ends of the device. A waterproof rubber frame can be attached to the bottom of the case so that when the present device is in use, the frame can entirely cover the socket.

2 Claims, 2 Drawing Sheets

PROTECTION DEVICE FOR USE ON ELECTRICITY SOCKET

FIELD OF THE INVENTION

The present invention relates to a protection device to be inserted into an electricity socket to protect one from getting an electrical shock by incident.

BACKGROUND OF THE INVENTION

Electricity has brought great facilitation to human life. However, just as fire and water, it can be a disaster by being applied inappropriately.

People usually install sockets at several spots inside and outside of their houses in order to get electricity conveniently. But coming along with such convenience, there are latent dangers which might be caused by these sockets such as: an electrical shock to an innocent young child who is trying to imitate adult's plug-in action with a conductive object; an electricity leak caused by inadvertent wetting while cleaning the house; and also, a socket rarely being used can possibly become an ideal nest for cockroaches, spiders or other bugs and causes insanitary troubles. It is therefore considerably necessary to make an improvement on a conventional socket to prevent the foregoing problems.

The object of the present invention is to provide a protection device which can be plugged into a socket and tightly close the holes of the socket so as to prevent them from getting wot and causing an electrical shock, and also to stop any bugs from entering into the holes.

DETAILED DESCRIPTION OF THE INVENTION

Figure 2:
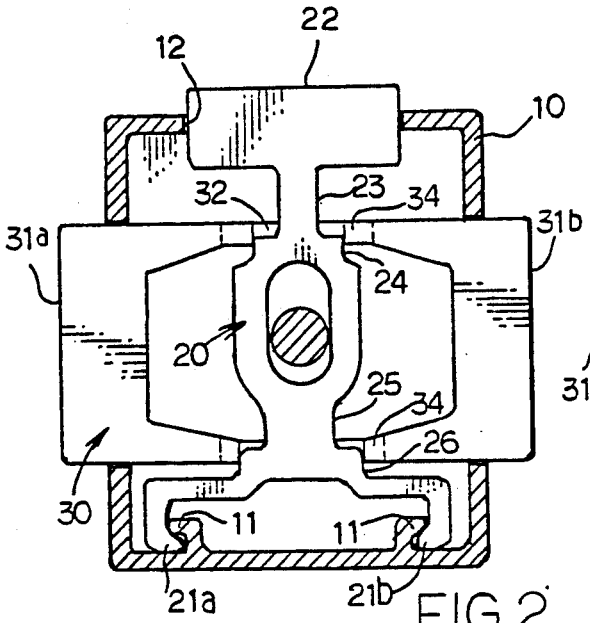
FIG. 2 is a sectional view taken along line 2—2 in FIG. 1.

The present invention as illustrated in the drawings is provided with a case 10 of non conductive material, and inside of the case 10 is a locking element 20 which is preferably made of elastic plastic materials. As shown in FIG. 2, there is formed at one end of the looking element 20 a pair of symmetric claws 21*a* and 21*b* clipping respectively a pair of lugs 11 on the internal wall of the case 10 while the opposite end of the locking element 20 projects out from a third hole 12 of the case to serve as a pressing end 22. Between this pressing end 22 and the pair of claws 21*a* and 21*b*, there are provided orderly a neck 23 next to the pressing end, a first shoulder 24, a waist 25 and a second shoulder 26. The widths of the neck 23 and the waist 25 are necessarily lesser than the widths of the first and second shoulders 24 and 26. These parts are formed so as to control the plugging or unplugging operation of the present invention.

Figure 1:
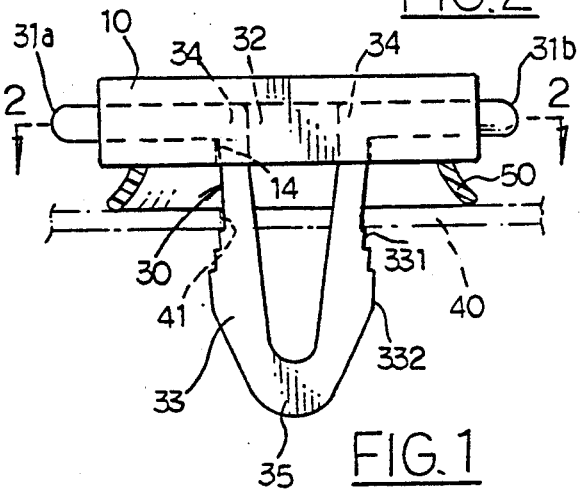
FIG. 1 is an elevational view of the present invention.

Stretching vertically to the locking element 20, there is a plugging element 30 of elastic non-conductive materials which includes a pair of pressing ends 31*a* and 31*b* projecting respectively out from the two opposite side holes 13*a* and 13*b* of the case 10. These holes 13*a* and 13*b* are in a cross direction to the third hole 12. The two pressing ends 31*a* and 31*b* are not jointed directly to one another on the same level; they are separated by the middle space of the plugging element, as shown in FIG. 1, to form a preparing area 32. Two bases are formed at respective pressing ends near the preparing area 32 and are stretching vertically downwardly through a pair of holes 14 at the bottom of the case 10 so as to become a part of the set legs 33 of the plugging element 30. The set legs 33 are provided with zigzag edge 331 on their outward sides. The preparing area 32 is designed to receive the foregoing first shoulder 24 and second shoulder 26 of the locking element 20 so as to secure the pressing ends 31*a* and 31*b* of the plugging element from being moved easily.

Figure 4:
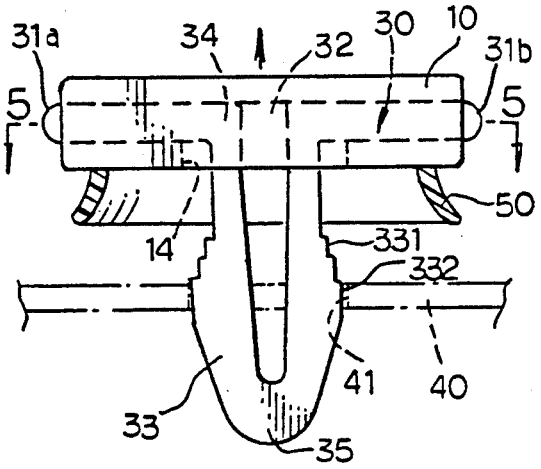
FIG. 4 is another elevational view similar to FIG. 1 showing the operation of pulling out the invention from the socket

The bases 34 of the set legs 33 extend downwardly from the end of the pressing ends 31*a* and 31*b* of the plugging element 31 and enlarge gradually to form a protrudent part 332. As a consequence, the zigzag edge 331 of the set legs formed between the base 34 and the protrudent part 332 is extending in a step-like configuration. The set legs 33 keep extending below the protrudent part 332 but are gradually contracting until two opposite set legs are jointed to form a connected part 35 whereby a pair of functional set legs 33 of the plugging element 30 are accomplished. Meanwhile the preparing area 32 is consequently enlarged along with the set legs to a long cavity. The width of the set leg at the protrudent part is generally kept greater than the length of the socket holes. As the two pressing ends 31*a* and 31*b* are pressed, the bases 34 will be forced to approach to the preparing area and therefore shorten the width of each set leg 33 at the protrudent parts 332 to be lesser than the length of the socket holes, as illustrated in FIG. 4, so as to enable the plugging element 31 to be pulled out from the socket.

Figure 3:
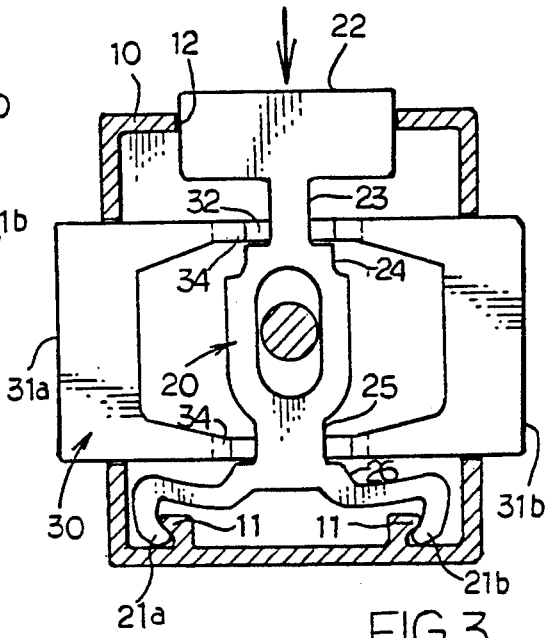
FIG. 3 is another sectional view similar to FIG. 2 showing the first step of the unplug operation of the present invention.
Figure 5:
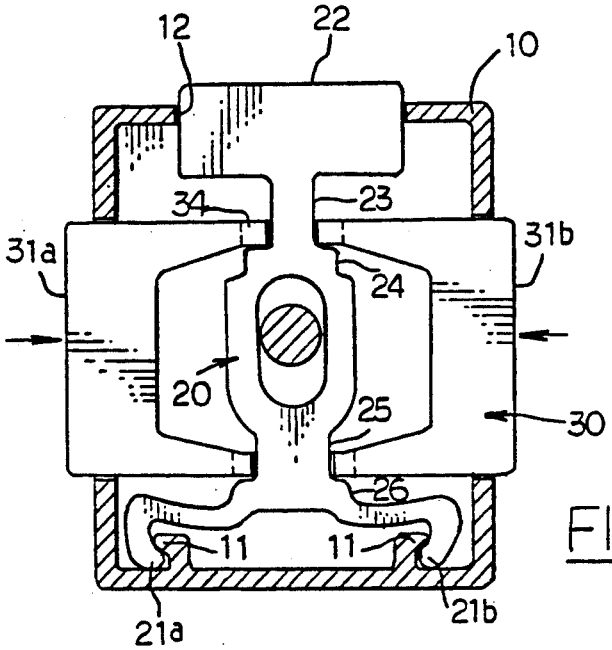
FIG. 5 is a sectional view taken along line 5—5 in FIG. 4.

Assembling the case 10, locking element 20 and the plugging element 30, a protection device of the present invention in a plug-like configuration can be achieved. To apply such device, one will just have to insert the above-mentioned pair of set legs 33 into the socket holes 41, the zigzag edges 331 on respective set leg will then be firmly stuck against the inside wall of the socket cover 40 and close the holes 41 tightly to stop any incident plug-in action by young children. To unplug the present invention from the socket, one will have to press the pressing end 22 firstly as indicated by the arrow in FIG. 3 to remove the first and second shoulders 24 and 26 of the locking element 20 from the preparing area 32, and then press the other two pressing ends 31*a* and 31*b* of the plugging element as shown in FIG. 5 with other fingers so as to force the bases 34 of the set legs to approach to the preparing area and reduce the width of the set legs until it is narrower than the length of the socket holes 41, consequently the zigzag edges 331 of the set legs 33 will be removed from the inside wall of the socket cover 40 and enable the plugging element 31 to be pulled out from the socket holes easily as shown in FIG. 4.

The foregoing procedure of the unplug operation must be practiced in order, otherwise this protection device can not be taken away from the socket. Such skillful operation will be a very difficult action for a child to achieve, so that they are well protected from incident contact to the electricity socket.

Figure 6:
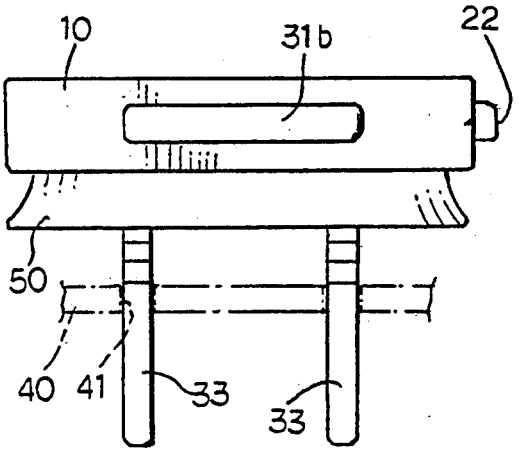
FIG. 6 is a side view of FIG. 1.

In order to perfect the present invention, it is considered by the inventor to further provide the above-mentioned structure with a waterproof rubber frame 50. As adopted in the embodiment in this application, the rubber frame is designed with flared end. FIGS. 1, 4 and 6 have illustrated that a rubber frame 50 is attached at the bottom of the case 10 with its flared end facing toward the set legs of the case 10. Because that the rubber frame 50 is located between the case 10 and the socket and is made of soft elastic materials, it can be tightly attached against the socket cover 40 and effectively prevent the holes of the socket from water or insects.

I claim:

1. A protection device for use on an electricity socket comprising:

a case which has two side holes provided at two opposite sides of said case, a third hole provided at a third side of the case, and a pair of holes provided at the bottom of said case for a plugging element to stick through;

a plugging element having a pair of elastic set legs extending downwardly through said pair of holes at the bottom of said case; said set legs each comprises a pair of bases extending horizontally to project out from said side holes of said case to serve as pressing ends, and each set leg has zigzag edge at its outward side to be stuck against the inside wall of a socket; meanwhile the width of said set legs is generally greater than the length of the socket holes;

a locking element provided in said case having at one end a pair of symmetric claws for keeping said locking element constantly in place and at the other end a pressing end projecting out through said third hole of said case; said locking element further comprises a neck, a first shoulder, a waist, and a second shoulder arranged orderly between said pressing end and said pair of claws wherein the widths of said neck and said waist must be lesser than that of said shoulders;

said base of each set leg not being connected directly so as to form a preparing area and extending downwardly by enlarging gradually to form a protrudent part which enables the width of said set leg at this part to be generally greater than the length of the socket holes; said first and second shoulders are generally kept in said preparing area so as to stop said set legs from being pressed to shorten its width easily.

2. A protection device for use on an electricity socket according to claim 1 wherein said case further comprises a frame made of soft waterproof material and provided with a flared end to be attached to the bottom of said case; as said set legs are inserted into the socket holes, said frame can thereby attach tightly against the cover of the socket.

* * * * *